US006539768B1

(12) United States Patent
Chen

(10) Patent No.: US 6,539,768 B1
(45) Date of Patent: Apr. 1, 2003

(54) RIVETING TOOL FOR FASTENING A HOLLOW RIVET TO A CURVED WORKPIECE

(76) Inventor: Dick Chen, No. 86, Wu-Ying Rd., Feng-Shan City, Kaohsiung Hsien (TW)

( * ) Notice: Subject to any disclaimer, the term of this patent is extended or adjusted under 35 U.S.C. 154(b) by 0 days.

(21) Appl. No.: 10/071,522

(22) Filed: Feb. 8, 2002

(51) Int. Cl.[7] ..... B21D 31/00; B21D 9/05

(52) U.S. Cl. ..... 72/391.8; 72/391.6; 29/243.526; 29/243.53

(58) Field of Search ..... 72/391.8, 391.6; 29/243.521, 243.526, 243.53

(56) References Cited

U.S. PATENT DOCUMENTS 2,428,459 A * 10/1947 Hollwarth ..... 72/391.8
3,654,792 A * 4/1972 Mead ..... 72/391.8
4,229,960 A * 10/1980 Nisson ..... 72/391.8
4,762,261 A * 8/1988 Hawly et al. ..... 29/243.53
5,771,738 A * 6/1998 Ko ..... 72/391.8

* cited by examiner

*Primary Examiner*—David Jones
(74) *Attorney, Agent, or Firm*—Kolisch Hartwell, P.C.

(57) ABSTRACT

A riveting tool for fastening a hollow rivet to a curved workpiece is disclosed. The tool includes a main body provided with a forwardly-extending barrel terminating in a forked distal end. The main body has a power-operated rotor formed with a central hexagon stem in alignment with the barrel. A sleeve is movable within the barrel to an extended position and is spring-loaded in such a way that it is normally in the extended position but may be retracted into the barrel when being pressed backward. The riveting tool further includes a screw having a socket head engaged with the central hexagon stem of the rotor. The screw extends out of the barrel through the sleeve.

6 Claims, 4 Drawing Sheets

RIVETING TOOL FOR FASTENING A HOLLOW RIVET TO A CURVED WORKPIECE

BACKGROUND OF THE INVENTION

1. Field of the Invention

The present invention relates to a riveting tool for fastening a hollow rivet to a curved workpiece and, more particularly, to a riveting tool which may fasten a hollow rivet to a curved workpiece without changing the inner diameter of the rivet.

2. Description of Related Art

Hollow rivets are widely used, for example, in bicycle and furniture industries. These rivets are usually fastened to plates or pipes for receiving and threadedly engaging with cooperated screws, which are used to connect the plates or pipes to something else.

There are various riveting tools for fastening such hollow rivets. However, these tools have a common problem that the inner diameter of the hollow rivets somewhere may become smaller after being fastened to curved workpieces, particularly pipes having a relatively large curvature.

This is because the hollow rivet has a flanged head that will be buckled during the riveting process, as a result of the difference between the curve of the workpiece and the flatness of the flanged head. The buckled head becomes non-circular and narrows the entrance into the interior of the hollow rivet. As a result, the cooperated screws can not be inserted into and threadedly engaged with the rivets.

Therefore, it is an objective of the invention to provide a riveting tool to mitigate and/or obviate the aforementioned problem.

SUMMARY OF THE INVENTION

The object of the present invention is to provide a riveting tool which may fasten a hollow rivet to a curved workpiece without changing the inner diameter of the rivet.

Other objects, advantages and novel features of the invention will become more apparent from the following detailed description when taken in conjunction with the accompanying drawings.

DETAILED DESCRIPTION OF THE PREFERRED EMBODIMENT

Figure 1:
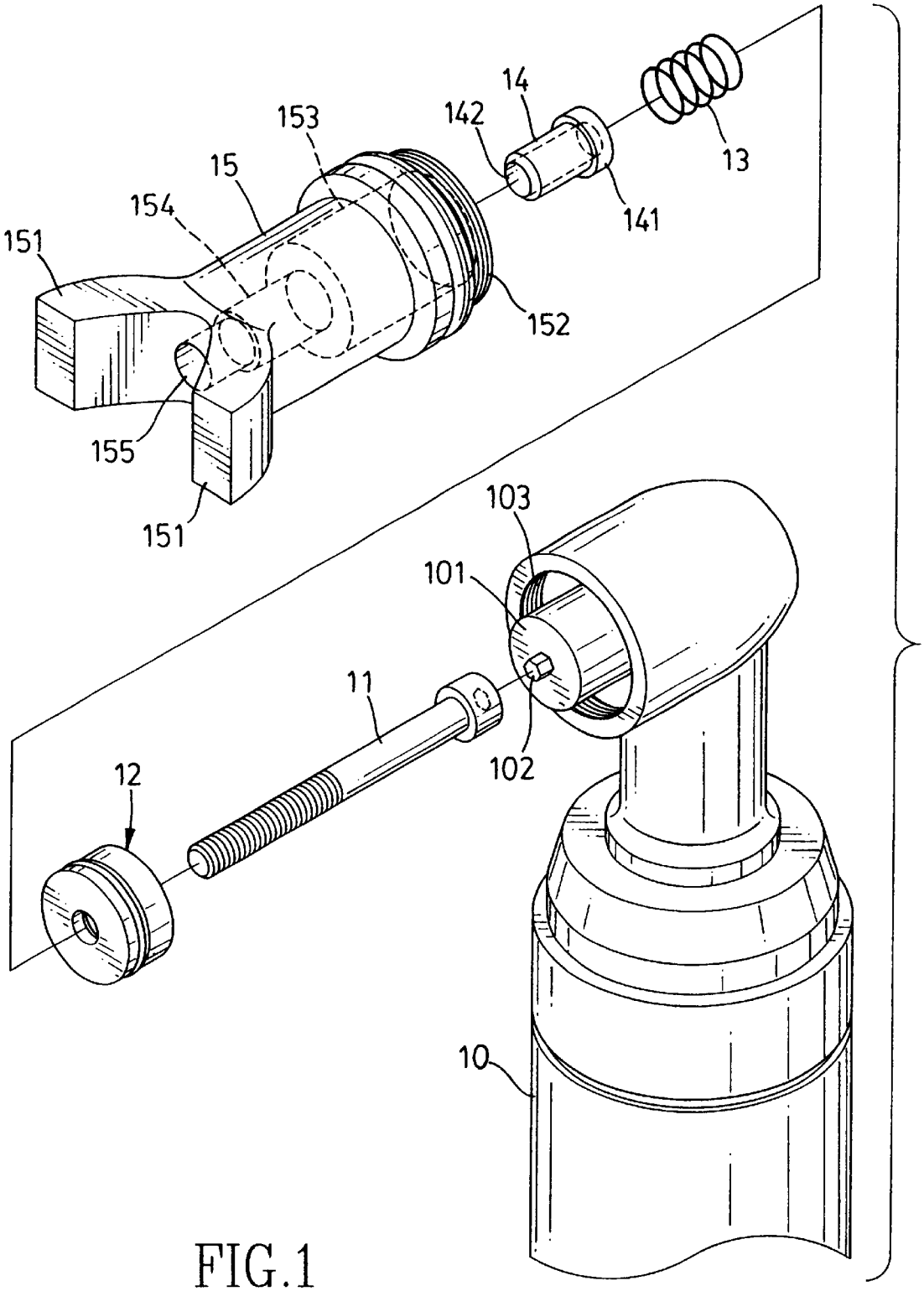
FIG. 1 is a fragmentary exploded perspective view of a preferred embodiment of a riveting tool in accordance with the present invention.

Referring to FIG. 1, a riveting tool in accordance with the present invention includes a main body (10) provided with a forwardly-extending barrel (15) which terminates in a forked distal end (151). The main body (10) has a power-operated rotor (101) formed with a central hexagon stem (102) in alignment with the barrel (15).

Preferably, the main body (10) further has a threaded collar (103) around the power-operator rotor (101) and the barrel (15) has a threaded proximal end (152) configured to mate with the threaded collar (103), thereby detachably connecting the barrel (15) with the main body (10).

The barrel (15) further defines an axially stepped through-hole (not numbered) that consists of a large diameter section (153) adjacent to the hexagon stem (102), a small diameter section (155) adjacent to the forked distal end (151) and an intermediate diameter section (154) between the large and small diameter sections (153, 155), as shown in dashed-lines.

Figure 2:
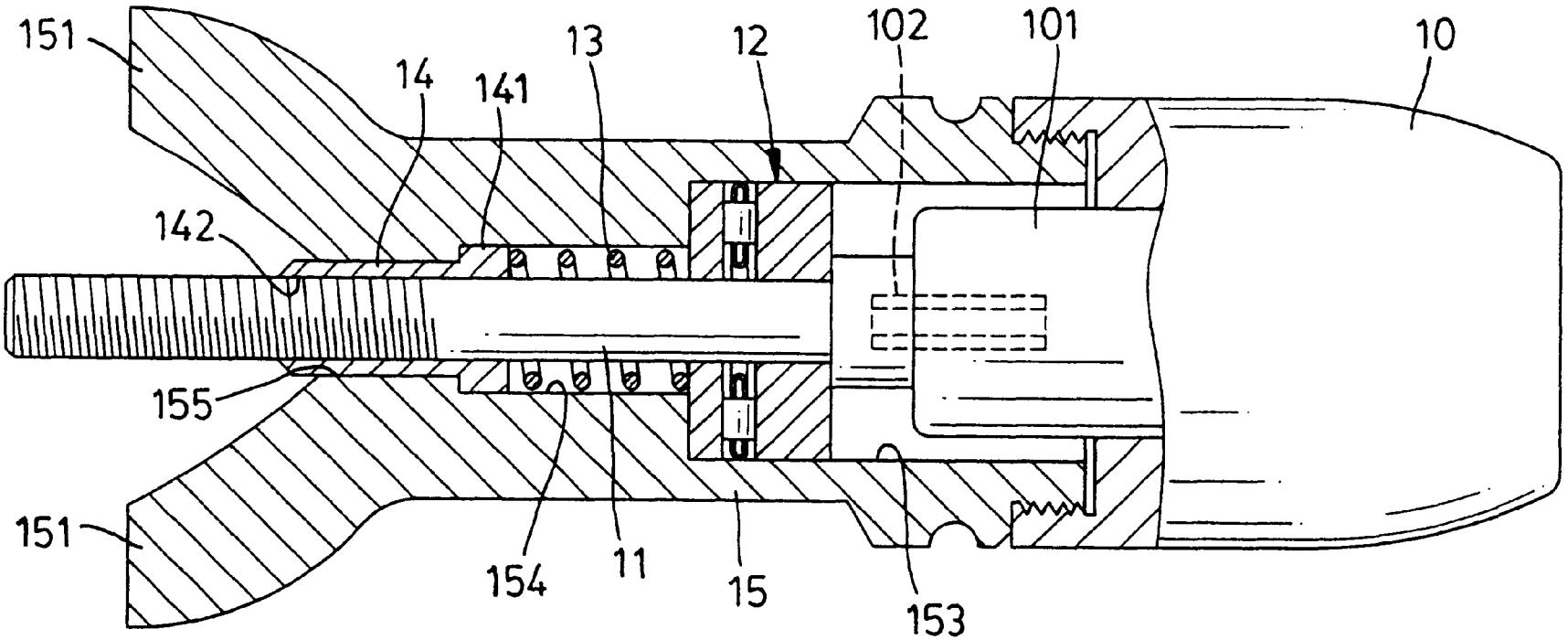
FIG. 2 is a partially cross-sectional top view of the riveting tool of FIG. 1.

Referring to FIG. 2, within the barrel (15) there is a bearing (12) retained in the large diameter section (153) and a sleeve (14) movably disposed in the small diameter section (155) of the stepped through-hole.

Figure 3:
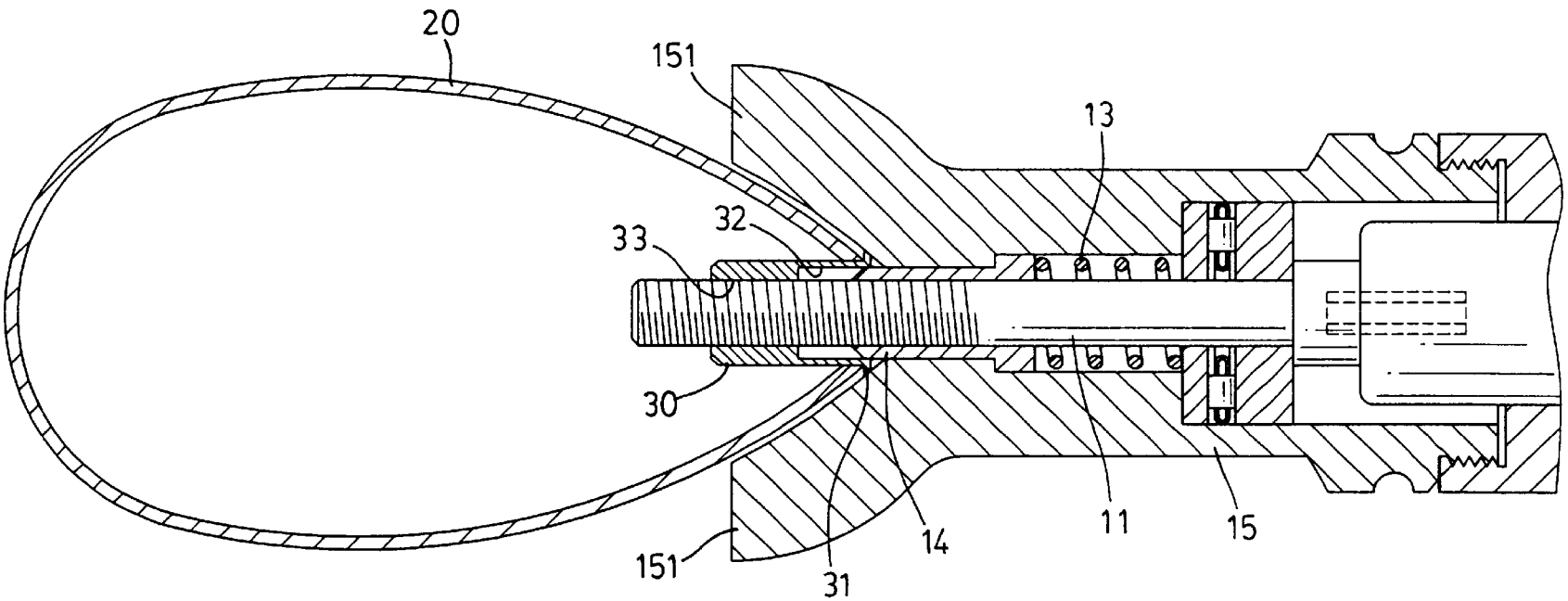
FIG. 3 is a fragmentary cross-sectional top view, showing a hollow rivet placed into a rivet hole in a pipe by the riveting tool of FIG. 1.

The sleeve (14) is movable relative to the barrel (15) to an extended position, as shown in FIG. 3. To this end, the sleeve (14) is formed with a flange (141) confined in the intermediate diameter section (154) of the stepped through-hole, thereby defining the extended position for the sleeve (14) as the forward movement of the flange (141) will be stopped by a shoulder formed between the intermediate diameter section (154) and the small diameter section (155).

Furthermore, the sleeve (14) is spring-loaded to be moved or urged to its extended position, such as by a spring (13) that is disposed within the barrel (15) in the intermediate diameter section (154) of the stepped through-hole and is compressed between the bearing (12) and the flange (142) of the sleeve (14), and so the sleeve (14) is allowed to be retracted into the barrel (15) when being pressed backward.

Also within the barrel (15) is a screw (11) which is rotatably supported in the bearing (12) and extends out of the barrel (15), through a central aperture (142) of the sleeve (14). Particularly, the screw (11) has a socket head snugly engaged with the central hexagon stem (102) of the rotor (101), and thus the screw (11) rotates as the rotor (101) is being driven.

Referring to FIG. 3, the inventive tool is provided for connecting a special pipe (20) with a hollow rivet (30) which is configured as shown in FIG. 3. In detail, the rivet (30) is shaped as a hollow body (32) formed with a flanged head (31) and an opposite threadedly-bored end (33).

The hollow rivet (30) must be threaded onto the screw (11) of the inventive tool until its flanged head (31) abuts the forked distal end (151) of the barrel (15), when the movable sleeve (14) is fit in the hollow body (32) of the rivet (30) at the flanged head (31). The rivet (30) around the screw (11) is then inserted into a rivet hole in the pipe (20), where a riveted connection is required.

Figure 4:
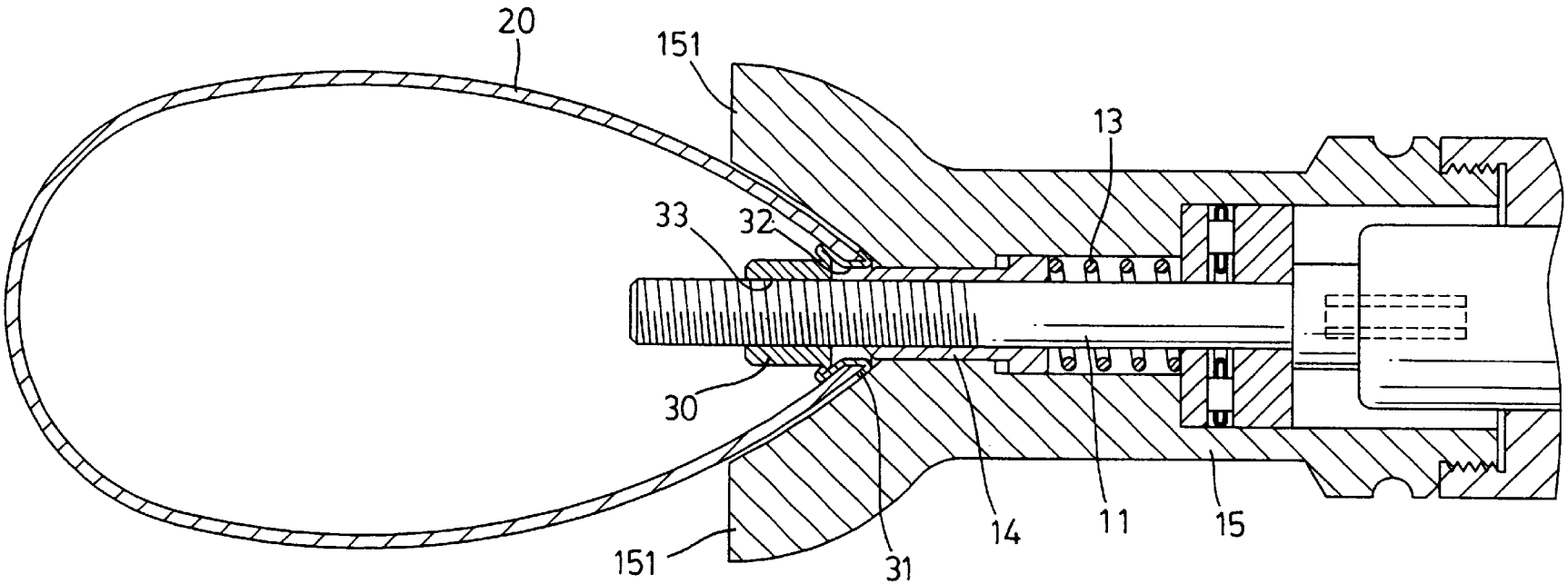
FIG. 4 is a fragmentary cross-sectional top view, showing the hollow rivet fastened to the pipe by the riveting tool of FIG. 1.

Referring to FIG. 4, the tool can be actuated as soon as it is pushed forward to press the flanged head (31) of the rivet (30) against an outer side of the pipe (20). Now the screw (11) begins to rotate, moving the threadedly-bored end (33) of the rivet (30) towards the head (31).

During the continuous movement of the threadedly-bored end (33), the hollow body (32) of the rivet (30) bulges out increasingly but its inner diameter at the flanged head (31) remain intact due to the fit-in sleeve (14), which may be retracted into the barrel (15) even if pressed backward by the approaching end (33).

The rivet (30) is fastened to the pipe (20) once the hollow body (32) of the rivet (30) is folded up and pressed against the inner side of the pipe (20), as clearly shown in FIG. 5. At this time, the screw (11) is turned out and disengaged from the rivet (30), leaving an unchanged inner diameter in the rivet (30).

From the above description, it is noted that the invention has the advantage that the hollow rivet (30) can be fastened to the pipe (20) or a curved workpiece without changing the inner diameter of the rivet.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A riveting tool for fastening a hollow rivet to a curved workpiece, comprising:

a main body (10) provided with a forwardly-extending barrel (15) terminating in a forked distal end (151), said main body (10) having a power-operated rotor (101) formed with a central hexagon stem (102) in alignment with said barrel (15);

a sleeve (14) movable within said barrel (15) to an extended position, said sleeve (14) being spring-loaded in such a way that it is normally in said extended position but may be retracted into said barrel (15) when being pressed backward; and a screw (11) having a socket head engaged with said central hexagon stem (102) of said rotor (101), said screw (11) extending out of said barrel (11) through said sleeve (14).

2. The riveting tool as claimed in claim 1, wherein said barrel (15) has an axially stepped through-hole with a large-diameter section (153) adjacent to said central hexagon stem (102), a small diameter section (155) adjacent said forked distal end (151) and an intermediate diameter section (154) between said large and small diameter sections (153, 155), and wherein said sleeve (14) is movable within said barrel (15) in said small diameter section (155) of said stepped through-hole.

3. The riveting tool as claimed in claim 2 further including a bearing (12) situated within said barrel (15) in said large diameter section (153) of said stepped through-hole for rotatably supporting said screw (11).

4. The riveting tool as claimed in claim 3, wherein said sleeve (14) has a flange (141) confined in said intermediate diameter section (154) of said stepped through-hole in said barrel (15), thereby defining said extended position of said sleeve (14).

5. The riveting tool as claimed in claim 4 further including a spring (13) disposed within, said barrel (15) in said intermediate diameter section (154) of said stepped through-hole and compressed between said bearing (12) and said flange (141) of said sleeve (14), thereby urging said sleeve (14) to said extended position but allowing said sleeve (14) to be retracted into said barrel (15) when said sleeve (14) is pressed backward.

6. The riveting tool as claimed in claim 1, wherein said main body (10) is formed with a threaded collar (103) around said power-operator rotor (101), and wherein said barrel (15) has a threaded proximal end (152) configured to mate with said threaded collar (103), thereby detachably connecting said barrel (15) with said main body (10).

* * * * *